US005222341A

United States Patent [19]

Watkins et al.

[11] Patent Number: 5,222,341

[45] Date of Patent: * Jun. 29, 1993

[54] METAL ROOFING PANEL CLIP

[76] Inventors: Neil A. Watkins, Rte. 5, Box 9; Robert Bowers, 510 Gillespie St., Unit C-18, both of Starkville, Miss. 39759

[ * ] Notice: The portion of the term of this patent subsequent to Mar. 26, 2008 has been disclaimed.

[21] Appl. No.: 667,551

[22] Filed: Mar. 11, 1991

Related U.S. Application Data

[63] Continuation-in-part of Ser. No. 520,361, Apr. 13, 1989.

[51] Int. Cl.[5] ..... E04D 1/34

[52] U.S. Cl. ..... 52/547; 52/520; 52/478; 52/573

[58] Field of Search ..... 52/547, 520, 478, 573, 52/489, 543, 544, 545, 546

[56] References Cited

U.S. PATENT DOCUMENTS 5,001,882 3/1991 Watkins et al. ..... 52/547

*Primary Examiner*—Richard E. Chilcot, Jr.

*Assistant Examiner*—Wynn Wood

*Attorney, Agent, or Firm*—Pravel, Hewitt, Kimball & Krieger

[57] ABSTRACT

A metal roofing clip member having a base portion, which is rigidly attachable to a roof purlin, an separate upper clip portion attached to the upper part of the base portion, the upper clip portion including means for allowing rotational and articulating movement of the upper clip portion relative to the stationary base member; a third lower portion, secured against the clip member, the lower portion including a first outwardly extending flange, and a pair of inward extending flange members, the pair of flange members defining a single plain wherein the upper level of the roofing seam rests thereupon, the lower member also providing means while being secured to the base member and the upper clip member allows rotational and transactional movement of the member both relative to the movable clip member and the stationary base member. In a second principal embodiment, the lower member would be secured to the base member and the upper clip member in such a manner as to allow only transnational movement of the lower member and the clip member in relation to the stationary base member.

8 Claims, 6 Drawing Sheets 126
127
128
144

126
133
128
131
144
127

30
64
60
56
54
50
52
20
62
27
51
40
29
42
31
32
10
36
38
34
24
25
144
126
128
127
18

METAL ROOFING PANEL CLIP

This is a continuation-in-part of co-pending U.S. application Ser. No. 520,361, filed on Apr. 13, 1989, entitled "Improved Metal Roofing Panel Clip", by the same inventor, hereby incorporated herein by reference.

BACKGROUND OF THE INVENTION

1. Field Of The Invention

The apparatus of the present invention relates to metal roofing. More particularly, the present invention relates to a clip, which is supported on its base to a joist or purlin, the upper portion of which supports metal roofing panels, while allowing transnational and/or sliding movement of the panels relative to the stationary base or purlin.

2. General Background

In the construction of buildings, one of the more common types of construction are the prefabricated buildings constructed of metal components. Such buildings are usually constructed of a metal frame, where metal panels of metal such as tin or other type of lightweight metal is laid edge-to-edge in order to form a continuous walled and roofed structure. In the area of the roof structure, due to the need to exclude moisture coming in through the top of the building, the roof panels are normally formed of overlapping sections, then formed into a seam by a mechanical roll former, to increase the strength and flexibility of the roof. Joist or purlin are positioned across the roof rafters, supported by the rafters. In view of the fact that the purlin would normally extend along the longest part or length of a metal building, the roofing system formed of the seamed panels is installed on the purlin, in such a manner as to form the standing seam between the panels.

This type of construction therefore lends itself to employing a particular type of device or clip for attaching the panels to the purlin at areas along the length of each of the panels. This can be easily done through the use of stationary clips, where an upper portion of the clip is clipped into the seam between the panels, and the clip is rigidly attached to the top of the purlin. However, one of the drawbacks to this type of construction is the fact that due to the load on metal load bearing characteristics of metal roofs, or due to the changes in the weather which may cause thermal expansion or contraction, clips which are rigidly and are non-movably attached to roofing panels, can not accommodate this expansion and contraction or load bearing characteristic, and therefore tend to either break under the stress, or create warping or bending of the roof, which in turn would lead to breaks or gaps in the seams and would not be a completely moisture-proof roof.

One of the more recent types of clips that have been invented is claimed and disclosed in U.S. Pat. No. 4,796,403, entitled "Articulating Roofing Panel Clip". In this particular clip, there is provided a clip which attaches to a portion of a standing seam to a rigid purlin of a metal building, and which attempts to accommodate the movement of the roofing panels relative to the rigid purlin. The clip would include an upper support section for engaging a portion of the standing seam of roofing panels to attach the clip to the roofing panels. There would also be provided a rigid base for supporting the clip portion of the apparatus, and for anchoring the entire clip to the purlin. There would be further provided a third member which is disclosed as an articulated bearing member, which is positioned intermediate the upper clip portion and the rigid base for attempting to enable rotational and transnational articulation between the upper clip portion and the rigid base and purlin. There would be further provided a connector to connect the upper clip to the articulating bearing member and to connect the bearing member to the rigid base. As disclosed, a drawback to this particular type of clip is that the central articulating bearing member, is engaged to the lower base portion via a single threaded rivet, and therefore there is no allowance for translational or rotational movement between the base and the articulating member. Therefore, the only articulation and translational movement is between the clip portion and the articulating bearing member after that member has been rigidly attached to the base portion. Therefore, were one wish to permit the movement of the intermediate member relative to the movement of the clip, it would not do so, the only movement would be between the clip and the intermediate member.

SUMMARY OF THE PRESENT INVENTION

What is provided in one embodiment of the present invention is a metal roofing clip member having a base portion, which is rigidly attachable to a roof purlin, a separate upper clip portion attached to the upper part of the base portion, the upper clip portion including means for allowing rotational and articulating movement of the upper clip portion relative to the stationary base member; a third lower portion, secured against the clip member, the lower portion including a first outwardly extending flange, and a pair of inward extending flange members, the pair of flange members defining a single plane wherein the upper level of the roofing seam rests thereupon, the lower member also providing means secured to the base member and the upper clip member allows rotational and transnational movement of the member both relative to the movable clip member and the stationary base member.

A second principal embodiment would allow only transnational movement of the member both relative to the movable clip member and the stationary base member, and would disallow any rotational movement whatsoever relative to the stationary base member.

It is a principal object of the present invention in a second principal embodiment to provide a multiple piece metal clip, having a rigid base portion attachable to a roof purlin, a separate clip portion, and a third lower base portion, both the lower base portion and the clip portion translationally movable relative to the rigid base and to one another, and yet disallowing any rotational movement of the clip portion relative to the rigid base.

Therefore, it is a principal object of the present invention to provide a multi-piece metal roofing clip having both a clip portion and a third body member rotationally and translationally movable relative to a rigid base portion.

It is still a further object of the present invention to provide a metal roofing clip having a clip portion, which is rotationally and translationally movable relative to the rigid base portion, for allowing movement of the clip during thermal expansion, thermal contraction, or other movement of the roofing panels caused by loading characteristics of the roof.

It is a further object of the present invention to provide a multi-piece metal clip, having a rigid base portion attachable to a roof purlin, a separate clip portion, and a separate lower base portion, both the lower base portion and the clip portion rotationally and translationally movable relative to the rigid base and to one another.

BRIEF DESCRIPTION OF THE DRAWINGS

For a understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 5:
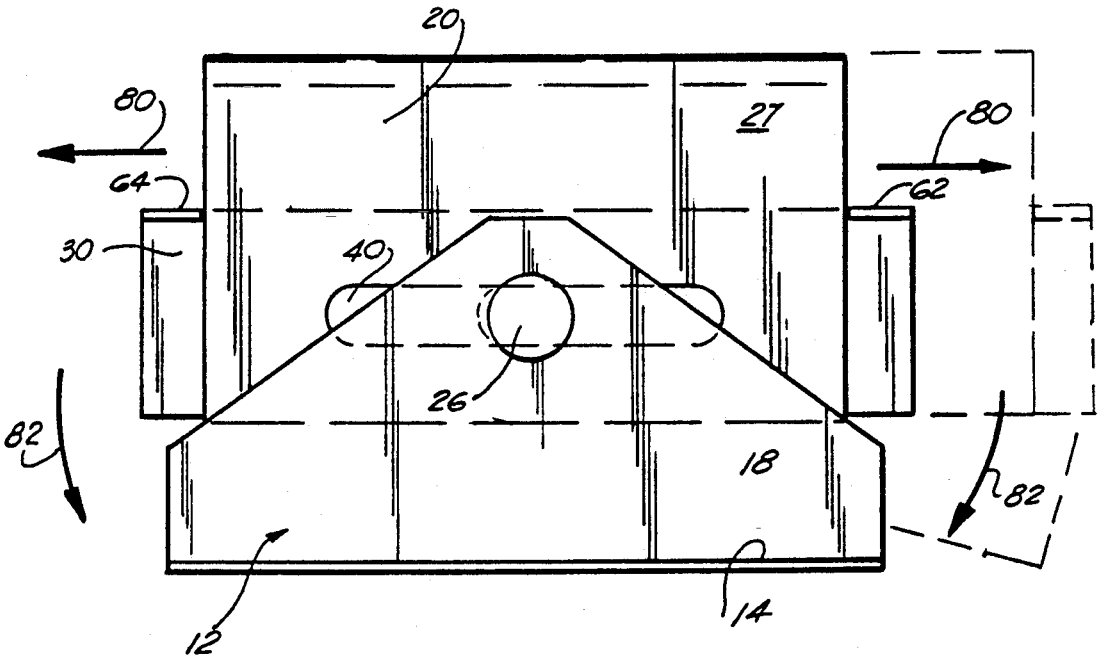
FIG. 5 illustrates a rear view of the preferred embodiment of the clip member of the present invention during transnational and rotational movement.
Figure 4:
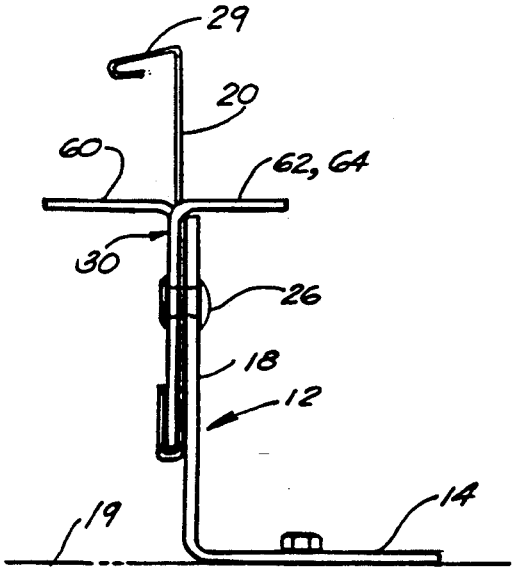
FIG. 4 represents an end view of the preferred embodiment of the clip member of the present invention.
Figure 6:
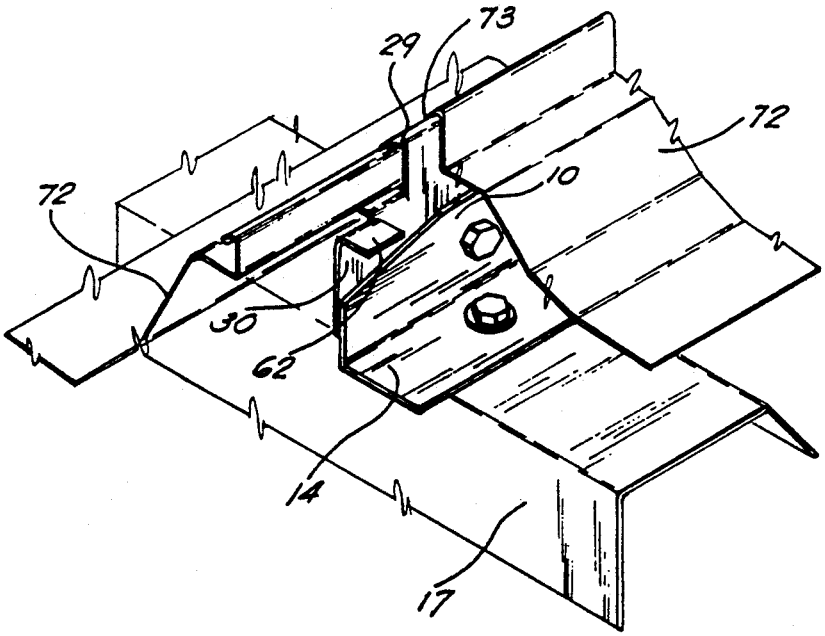

The preferred embodiment of the apparatus of the improved roofing clip member is illustrated in FIGS. 1 through 7 by the numeral 10. As is illustrated, improved clip 10 would include a first base portion 12 having a flat base 14, including a plurality of ports 16 for rigidly attaching to a roof purlin 17, as seen in FIG. 6. There would be also secured to base member 12 a roofing clip portion 20 and a lower support portion 30, the function of which will be described further.

Returning to the description and function of base member 12, base 12 also has an upper extending portion 18, formed by an L bend and a continuation of base plate 14, with upper extending portion 18 formed into a truncated peak portion 19, with sloping upper edges 21 and 23 respectively. As seen, the upper extending portion 18 has a port 24 therethrough, for accommodating a single support member, such as a screw or rivet 26, the function of which will be described further.

Therefore, for purposes of function, base member 12 is firmly secured to the purlin 17, and serves as the rigid attachment for the clip 10 when the clip 10 is securing the standing seam of a pair of adjoining roof panels 72 as seen more clearly and will be described further in FIG. 7.

Figure 2:
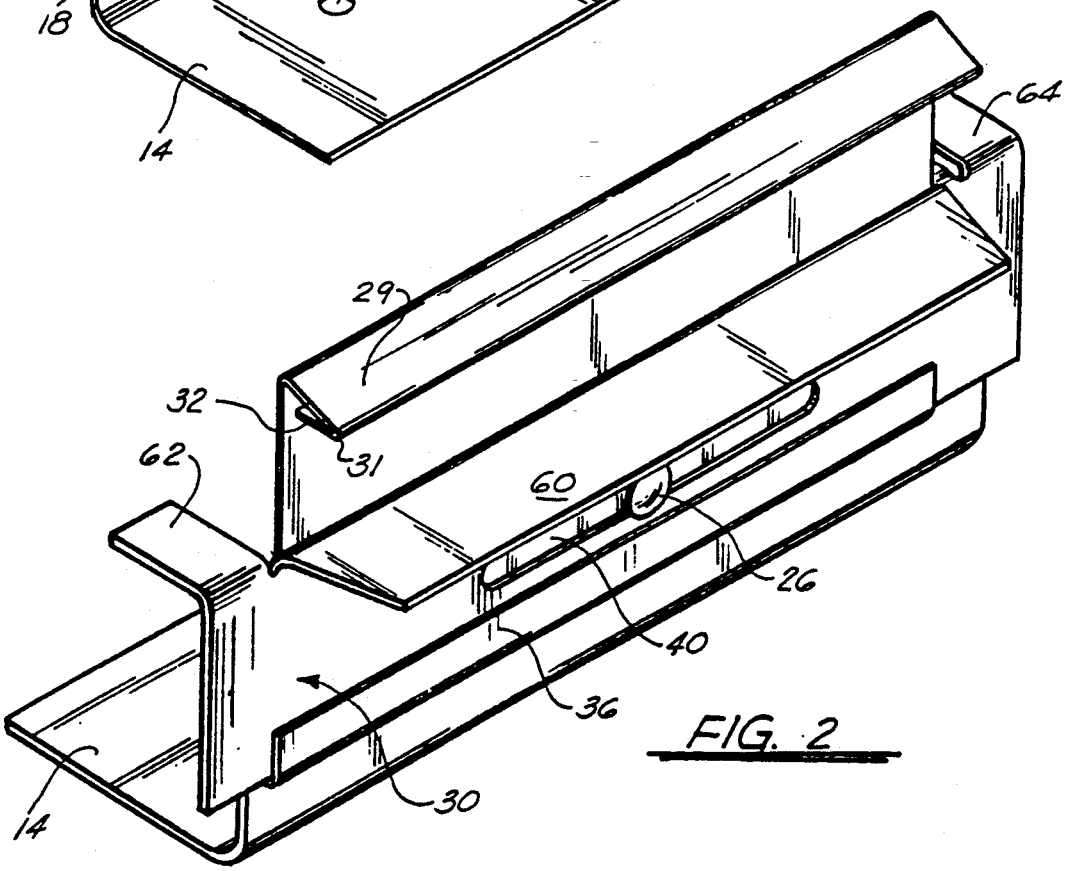
FIG. 2 illustrates a frontal perspective view of the improved clip member of the present invention.
Figure 3:
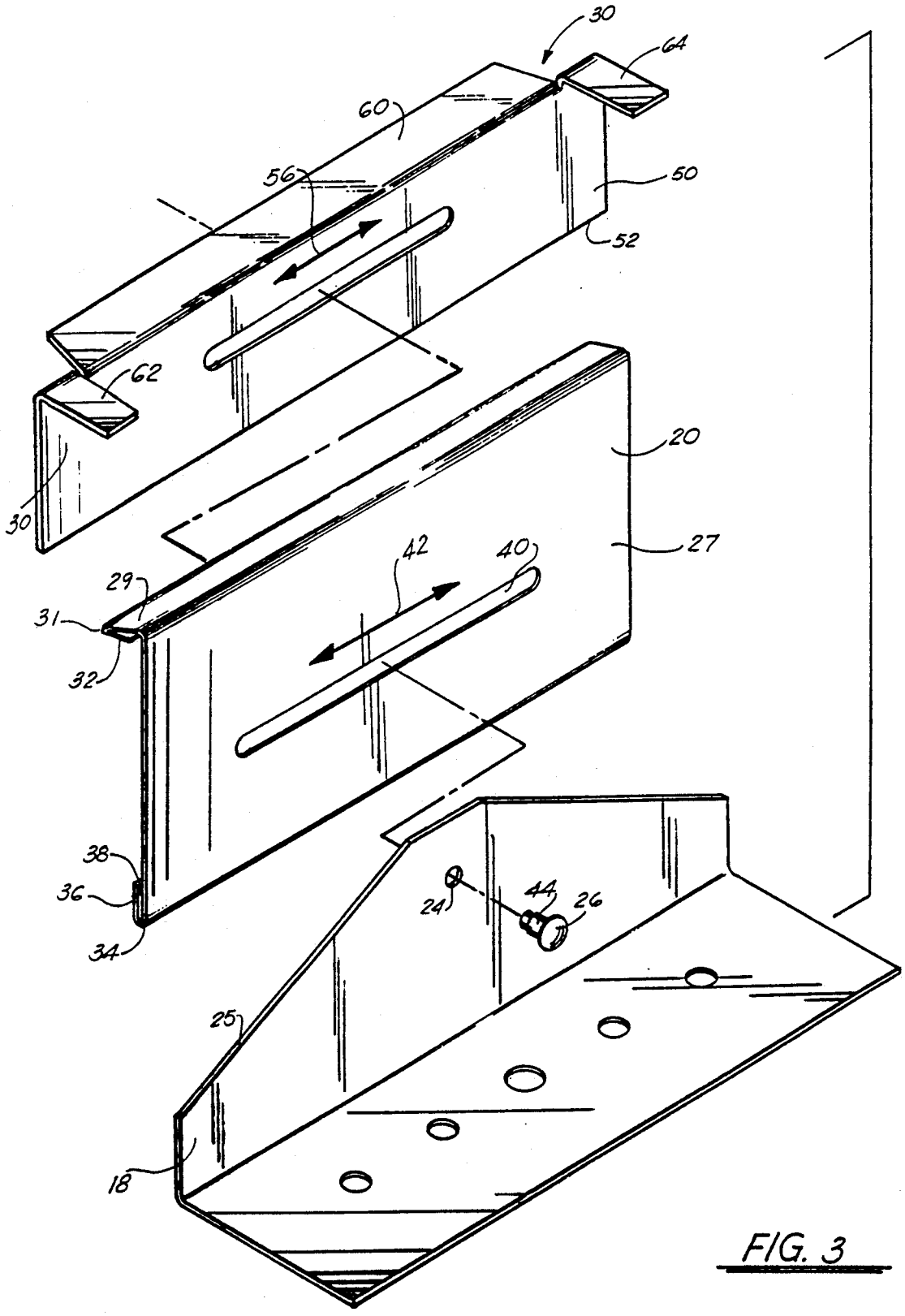
FIG. 3 illustrates an exploded view of the improved clip member of the present invention.

Turning now to several other components in the improved clip 10, reference is made to FIGS. 2 and 3. As seen in the Figures, second component is secured flush against the backside 25 of upper extending base portion 18. This component provides upper clip member 20 having an upstanding main body portion 27, and upstanding portion 27 having a folded upper clip portion 29, which is folded inward at its outer edge 31 to a lower inwardly depending lip portion 32. At its lowermost end 34, body portion 27 forms a U-shaped upward depending end member 36 for defining a U-enclosure 38, the function of which will be described further.

Figure 1:
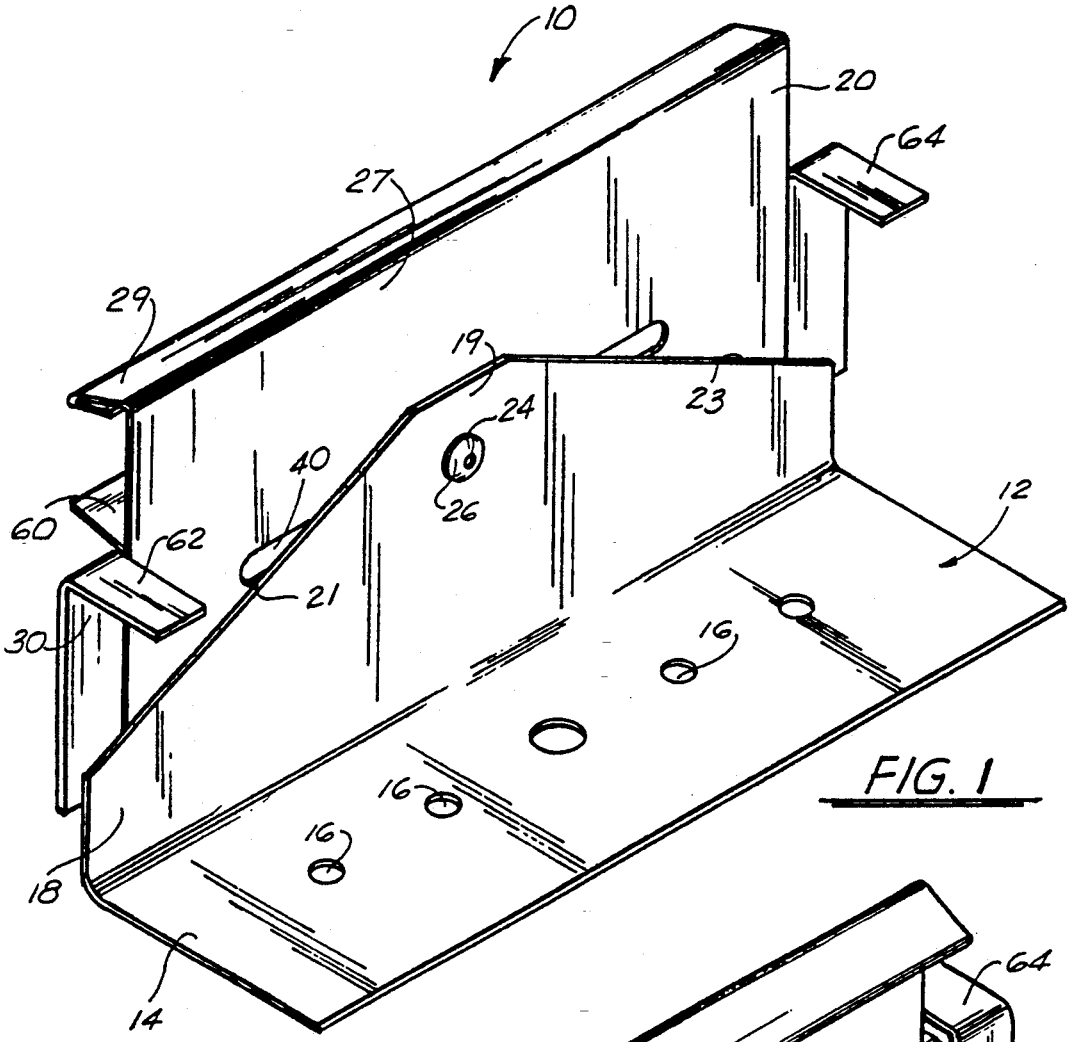
FIG. 1 illustrates a rear perspective view of the preferred embodiment of the improved roof clip member of the present invention.

As further illustrated, clip body portion 27 includes an elongated slot 40, which is substantially intermediate the upper and lower ends of the body portion 27, and extending substantially along the greater portion of its length, slot 40 defining a means for allowing sliding movement of clip portion 20 in the direction of arrows 42 as will be described further. Furthermore, as indicated, slot 40 would accommodate the post 44 of rivet 26, when rivet 26 is positioned through port 24 for maintaining the clip portion 20, positioned adjacent the backside 25 of base 12, as seen in FIG. 1.

The third component, a lower bracket portion 30, as further seen in FIG. 3, would also include a substantially main body portion 50, of substantially the same length as clip portion 20, and with body portion 50 having a lower edge 52, which, as seen in FIG. 2, would reside in the slot 38 formed by upward depending lip member 36 of clip 20. Likewise, body portion 50 would include an elongated slot 54 which would be substantially aligned with slot 40, when the lower edge 52 of member 30 is positioned within groove 38. Likewise, the backside 51 of body 50 would be positioned flush against the backside of body portion 27 and likewise rivet post 44 would be engaged through slot 54, so that once riveted all three components would be formed to form the single 10 clip 10 as illustrated in FIGS. 1 and 2. In addition, slot 54 would likewise allow transnational movement of member 30 in the direction of arrow 56, in relation, both to the transnational movement of clip portion 20, and relative to the stationary fixed position of base portion 12.

As further seen, body portion 30 would include a principal lip 60, extending forward out from the top edge of body 50, and a pair of secondary lips 62 and 64, each of which are positioned at the very end portion of body 50, and extend in the opposite direction as illustrated in FIG. 3. As seen, the width of lip 60 is substantially of similar width as the entire body portion 27, of clip member 20. Therefore, when the three components are held together via rivet 26, body portion 20 would reside intermediate the pair of inward depending lips 62 and 64, and therefore member 30 would be held in place so that as any transnational movement of clip member 20 would likewise impart the similar transnational movement to member 30. Likewise, any rotational movement of clip member 20, due to its rotating on the axis of post 44 of rivet 26, would impart similar rotational movement to body portion 30, as seen more clearly in FIG. 5. This is so, simply because member 30 is both set in place within channel 38 of U-shaped lip 36, and is further held in place via the pair of lip members 62 and 64 that are positioned on both edges of clip portion 20.

Figure 7:
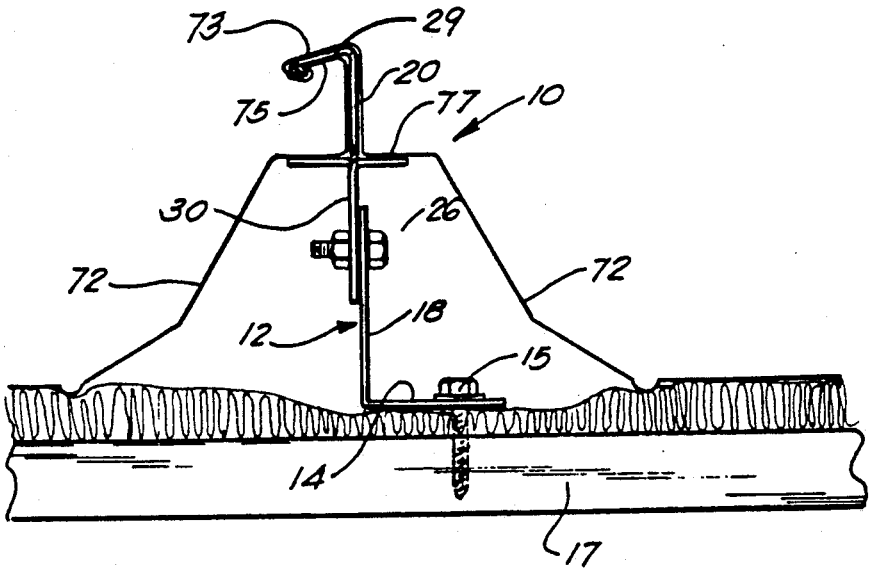
FIGS. 6 and 7 illustrate end and isometric views of the improved clip member attached to the standing seam adjacent metal roof panels.

Further, in the functioning, as seen side view in FIGS. 7, and in isometric view in FIG. 6, as was illustrated base portion 14 of clip 10 is secured to the upstanding portion 18 of base 12, with clip 20 secured thereto via bolt 26. Furthermore, there is provided the third member 30 likewise secured to the base 12, via rivet 26, with clip member 20 held in place intermediate the member 30 and the base portion 18. As further seen, the principal lip 60 of member 30 is extending in one direction and the pair of lips 62, 64 are extending in the opposite direction, with the upper portion 29 of clip 20 extending upwardly the height above both the body member and the base of the clip 12, so as to serve as the means for securing onto the adjoining roof panels 72, as seen more clearly in FIG. 7. Since the base portion 14 of base means 12 is secured onto a purlin 17 via a screw member 15, the entire component 10 is held securely in place. Therefore, the end portions 73 of each of the roof panels 72 where they adjoin at upper portion 20, are then formed into place to curl around the end portion 29 of clip portion 20, with the use of a mechanical roll former that would run along the seam and fold it in place. Therefore, clip apparatus 10, would serve to both hold the formed seams 75 in place, and support the upper shoulder 77 of adjoining roof panels 72, resting in place on principal lip 60, and secondary lip 62, 64 as illustrated in the Figures.

However, as for the principal use of the clip, it should be noted as illustrated in FIG. 5 that because the clip portion 20 is provided with the slot 40, and held in place by a single rivet 26, clip 20 together with member 30, which is secured to clip 20, both enjoy sliding transnational movement in the direction of arrows 80, as seen in FIG. 5, and rotational movement in the direction of arrows 82, likewise as seen in FIG. 5. In this regard, this clip therefore is able to afford the flexibility of transnational and rotational movement to accommodate any expansion or contraction of standing seams for metal roofs, as was described earlier.

Figures 8, 9A, 9B:
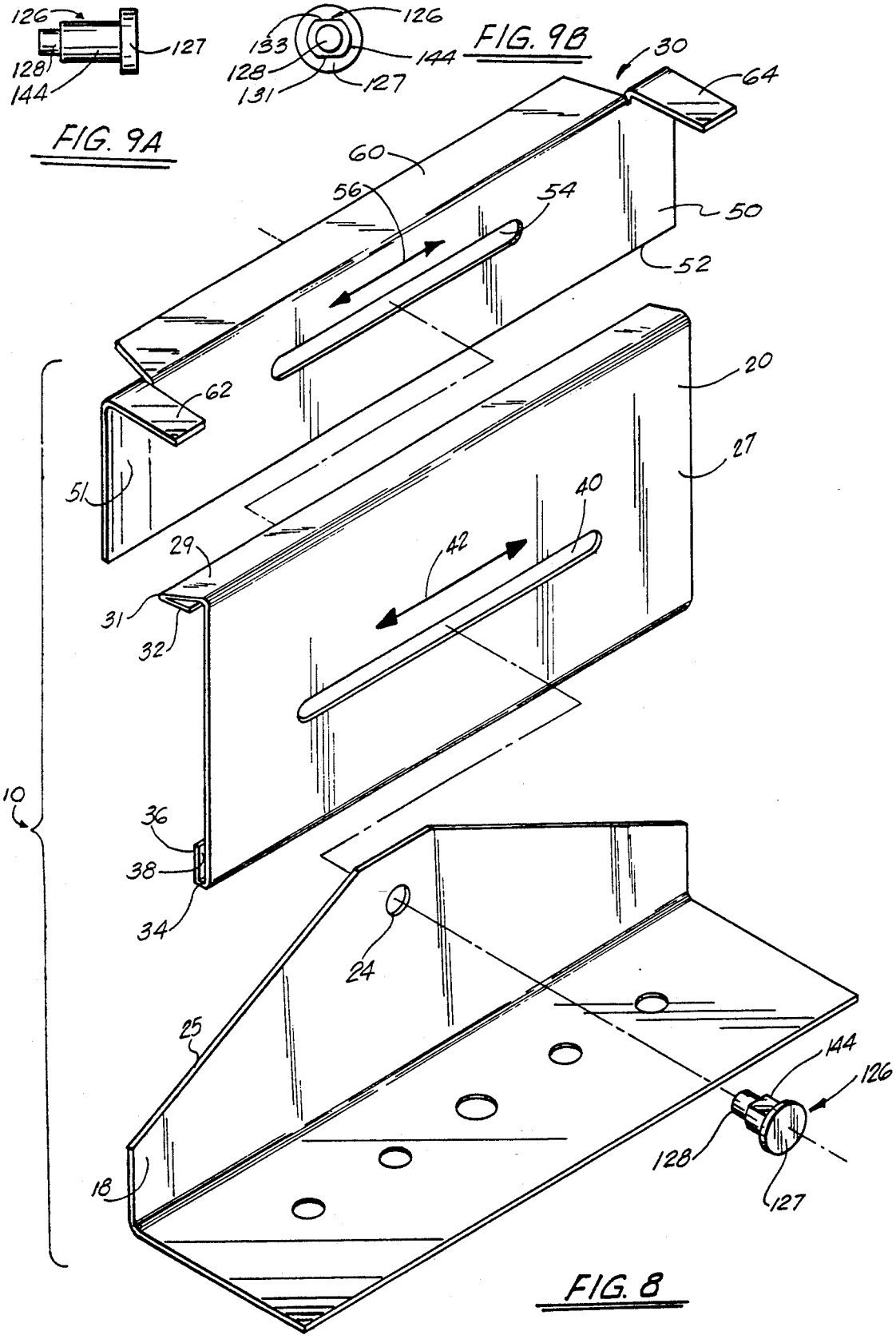
FIG. 8 illustrates an overall exploded view of the second principal embodiment of the apparatus of the present invention.
FIGS. 9A and 9B illustrate side and front views respectively of the improved rivet member of the present invention.

FIGS. 8-11 illustrate a second preferred embodiment of the apparatus of the present invention by the numeral 10 as illustrated in FIG. 8. Rather than repeat a discussion of the structure and functioning of the second embodiment as illustrated in FIGS. 8-11, reference can be had to a discussion of FIGS. 1-7 since the second principal embodiment functions quite similar to the first principal embodiment as illustrated in those figures, with the exception of the fact that the second principal embodiment does not allow any rotational movement whatsoever of the roofing clip portion 20, and the lower support portion 30, in relation to the base portion 12 as illustrated in the figures. As discussed in the principal embodiment, the means by which the base portion 12, the clip portion 20, and the base portion 30 are held together or maintained as a unit as illustrated in the figures, is for the use of a rivet 26 as illustrated in the first principal embodiment in FIG. 1. However, due to the configuration of the post portion of rivet 26, in the first embodiment, the base portion 30 and the clip portion 20 is able to both translate and rotate as illustrated in FIG. 5 relative to the stationary base member 12.

Figure 10:
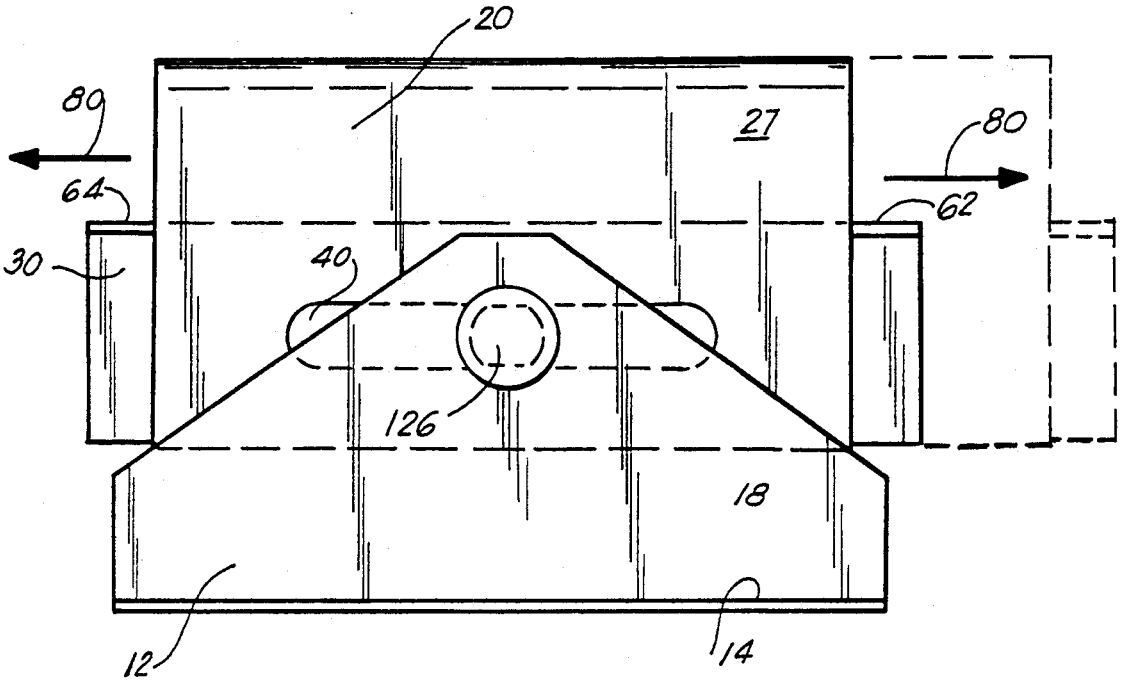
FIG. 10 illustrates a rear view of the second preferred embodiment of the clip member of the present invention illustrating transnational movement.
Figure 11:
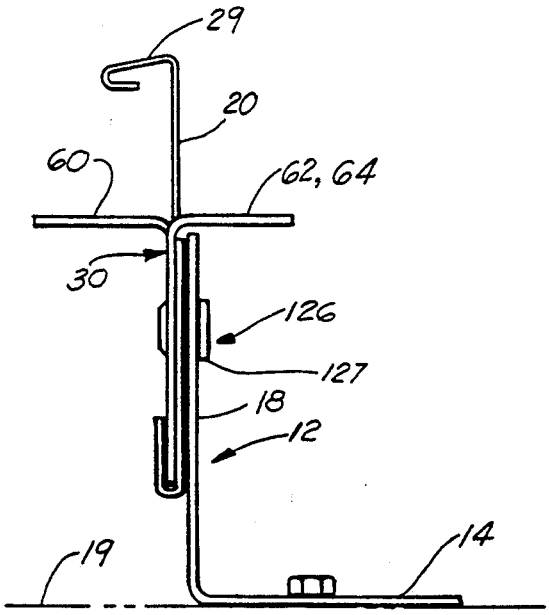
FIG. 11 illustrates an end view of the second preferred embodiment of the clip member of the present invention.

However, in the second principal embodiment, reference is made to FIGS. 8, 9A and 9B, wherein there is illustrated a modified rivet 126, having a circular head portion 127, an end portion 128, with a modified body portion 144 therebetween. The construction of the body portion 144 includes a pair of opposite flat side walls 131, 133 as illustrated in FIG. 9B, so that when body portion 144 is inserted through port 24 of base portion 12, and into the elongated slot 40 and elongated slot 54 respectively of members 20 and 30, the flat walls 131 and 133 are engaged along the interior edges of slots 40, 54 (see FIG. 10), and therefore would preclude any rotational movement of clip member 20 and base member 30 in relation to base 12, as illustrated in FIG. 10. The only movement which is allowed as seen in the direction of arrows 80, is the transnational movement of member 20 and member 30 in relation to base 12. Therefore, unlike the principal embodiment as illustrated in FIG. 5, the second principal embodiment as illustrated in FIG. 10, allows no rotational movement whatsoever of member 20 and 30, and therefore would preclude any such movement during the operation of this particular embodiment of the apparatus. In all other respects, however, the clip members in both embodiments operate in the same fashion, in their interconnection between the roof and a purlin in the functioning of the apparatus when it is in place.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An improved metal roofing panel clip for securing metal roof panels to a rigid roof foundation, the improved clip comprising:

a) a base member rigidly secured to a roof purlin;

b) a lower support member attached to the base member, the lower support member including a first lip portion extending outwardly away from the base member, and a pair of spaced apart second lip members extending in the opposite direction as of the first lip member, the lower support member further comprising a slot for accommodating translational movement of the lower support member in its attachment to the base member;

c) an upper clip member positioned intermediate the the base member and the lower support member, the upper clip member further comprising a lowermost channel means for supporting the lower edge of the lower support member therein, and positioned between the spaced apart clip members and likewise translationally movable in relation to the movement of the lower support member; and d) means interconnecting the base member, the clip member and the lower support member for allowing translational movement only of the clip member and lower support member relative to the base member.

2. The apparatus in claim 1, wherein the base member further comprises a flat base portion screwed to a purlin, and an upwardly extending second portion for supporting the upper and lower clip members.

3. The apparatus in claim 1, wherein the base member is secured to the lower support member and the upper clip member via a rivet having at least one flat wall.

4. The apparatus in claim 1, wherein the upper clip member further provides an outwardly extending lip portion for engaging a roof panel supporting the upper clip member thereupon.

5. The apparatus in claim 1, wherein the upper clip member is of the necessary width to be positioned between the pair of spaced apart lip members along the length of the lower support member.

6. The apparatus in claim 1, wherein the upper clip member and the lower clip member further comprise elongated slots within their body portions, with the rivet of the base portion extending through the slots and allowing only translational movement of the upper clip member and the lower support member in relation to the rigid base member.

7. An improved metal roofing panel clip, comprising:

a) a rigid base member secured to a purlin of a metal standing roof;

b) a first lower support member, further comprising a slot along the length of its body portion;

c) an upper clip member, positioned intermediate the base member and the lower support member, the upper clip member further comprising a slot substantially along its body; and d) a post member secured through a port in the rigid base member, and through the slots in the lower support member and the upper clip member, for supporting the upper clip member and lower support member on the post, yet allowing translational movement of the upper clip member and lower support members in relation to the rigid base portion, for allowing expansion and contraction of the metal roof during various types of environments.

8. The clip in claim 7, wherein the past member further comprises at least two opposite flat walls that engage the edges of the slots in the lower support member and clip member to prevent rotational movement of the support and clip members relative to the rigid base member.

* * * * *